US008847724B2

(12) United States Patent
Kim et al.

(10) Patent No.: US 8,847,724 B2
(45) Date of Patent: Sep. 30, 2014

(54) LAMINATED INDUCTOR

(75) Inventors: Myeong Gi Kim, Gyunggi-do (KR); Sung Yong An, Gyunggi-do (KR)

(73) Assignee: Samsung Electro-Mechanics Co., Ltd., Suwon, Gyunggi-do (KR)

( * ) Notice: Subject to any disclaimer, the term of this patent is extended or adjusted under 35 U.S.C. 154(b) by 0 days.

(21) Appl. No.: 13/620,655

(22) Filed: Sep. 14, 2012

(65) Prior Publication Data

US 2013/0069752 A1 Mar. 21, 2013

(30) Foreign Application Priority Data

Sep. 21, 2011 (KR) ..... 10-2011-0095245

(51) Int. Cl.

| | |
|---|---|
| ***H01F 27/24*** | (2006.01) |
| ***H01F 27/02*** | (2006.01) |
| ***H01F 5/00*** | (2006.01) |
| ***H01F 17/00*** | (2006.01) |
| ***H01F 3/14*** | (2006.01) |
| *H01F 27/29* | (2006.01) |

(52) U.S. Cl.

CPC ..... *H01F 3/14* (2013.01); *H01F 17/0033* (2013.01); *H01F 27/292* (2013.01)

USPC ..... 336/233; 336/83; 336/200; 336/234

(58) Field of Classification Search

USPC ..... 336/233, 234, 200, 223, 232, 83; 428/210, 195

See application file for complete search history.

(56) References Cited

U.S. PATENT DOCUMENTS

| | | | | |
|---|---|---|---|---|
| 4,025,379 | A * | 5/1977 | Whetstone | 29/609 |
| 5,753,376 | A * | 5/1998 | Ikuina et al. | 428/469 |
| 2001/0030593 | A1 * | 10/2001 | Imada et al. | 336/200 |
| 2001/0033219 | A1 * | 10/2001 | Iha et al. | 336/90 |

FOREIGN PATENT DOCUMENTS

| | | | |
|---|---|---|---|
| JP | 09-186017 | A | 7/1997 |
| JP | 2004-128004 | A | 4/2004 |

* cited by examiner

*Primary Examiner* — Alexander Talpalatski
*Assistant Examiner* — Mangtin Lian
(74) *Attorney, Agent, or Firm* — McDermott Will & Emery LLP

(57) ABSTRACT

There is provided a laminated inductor including: a body in which a plurality of magnetic layers are stacked; at least one non-magnetic layers interposed between the magnetic layers and including a $Al_2O_3$ dielectric material and a K—B—Si-based glass; and a plurality of internal electrodes formed on the magnetic layers.

4 Claims, 3 Drawing Sheets

LAMINATED INDUCTOR

CROSS-REFERENCE TO RELATED APPLICATIONS

This application claims the priority of Korean Patent Application No. 10-2011-0095245 filed on Sep. 21, 2011, in the Korean Intellectual Property Office, the disclosure of which is incorporated herein by reference.

BACKGROUND OF THE INVENTION

1. Field of the Invention

The present invention relates to a laminated inductor.

2. Description of the Related Art

An inductor, a main passive element constituting an electronic circuit together with a resistor and a capacitor, is used in a component, or the like, removing noise or constituting an LC resonance circuit.

The inductor may be classified as one of various types thereof, such as a winding-type inductor or a thin-film type inductor, manufactured by winding a coil around, or printing a coil on, a ferrite core and forming electrodes at both ends thereof, and a laminated inductor manufactured by printing internal electrodes on magnetic materials or dielectric materials and then stacking the materials, or the like, according to a structure thereof.

Among these types of inductor, since the laminated inductor may have a size and a thickness decreased, as compared to the winding type inductor, and is advantageous for direct current (DC) resistance, it is widely used in a power supply circuit requiring miniaturization and high current.

Meanwhile, a power inductor using high current is required to have a low inductance change rate with respect to current and temperature. However, the winding type inductor according to the related art is defective in that an inductance change rate is high, according to an application of current.

SUMMARY OF THE INVENTION

An aspect of the present invention provides a laminated inductor capable of having improved inductance change characteristics according to a current application while having a reduced size and a high current.

According to an aspect of the present invention, there is provided a laminated inductor including: a body in which a plurality of magnetic layers are stacked; at least one non-magnetic layers interposed between the magnetic layers and including a $Al_2O_3$ dielectric material and a K—B—Si-based glass; and a plurality of internal electrodes formed on the magnetic layers.

The $Al_2O_3$ dielectric material may have a content of 40 to 60 wt % based on 100 wt % of an overall composition.

The $Al_2O_3$ dielectric material may have a particle diameter of 500 nm or less.

The K—B—Si-based glass may be glass in which 10 to 15% of $K_2O$—$B_2O_3$ may be substituted.

The internal electrode may be formed of at least one of silver (Ag), platinum (Pt), palladium (Pd), gold (Au), copper (Cu), and nickel (Ni), or an alloy thereof.

The laminated inductor may further include first and second external electrodes formed on outer surfaces of the body and respectively connected to both ends of the internal electrodes.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE EMBODIMENTS

Figure 1:
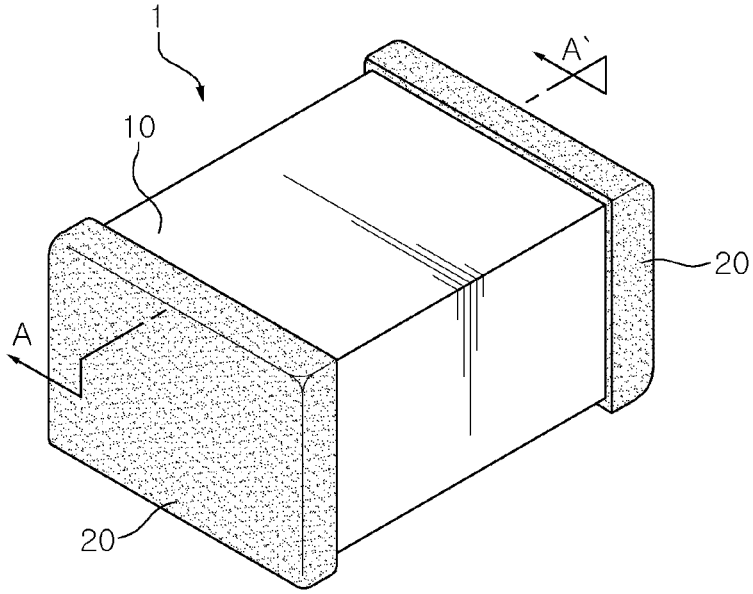
FIG. 1 is a perspective view showing a laminated inductor according to an embodiment of the present invention.

Hereinafter, embodiments of the present invention will be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like elements.

Figure 2:
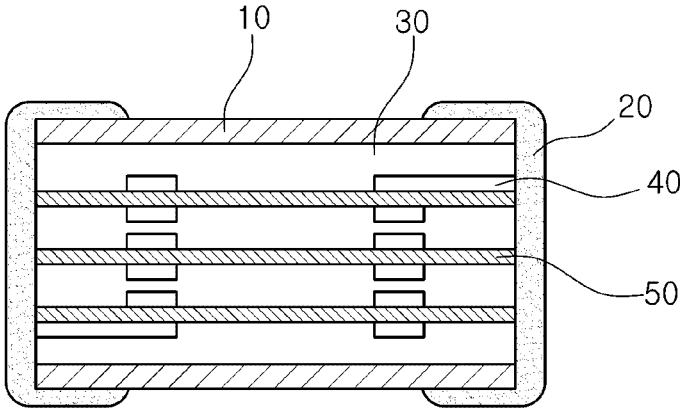
FIG. 2 is a cross-sectional view taken along line A-A' of FIG. 1.

Referring to FIGS. 1 and 2, a laminated inductor 1 according to an embodiment of the present invention may include a body 30 in which a plurality of magnetic layers are stacked, non-magnetic layers 50 interposed between the magnetic layers in the body 30, and a plurality of internal electrodes 40 formed on the magnetic layers. First and second external electrodes respectively connected to both ends of the internal electrodes 40 may be formed on outer surfaces of the body 30.

The internal electrodes 40 may be formed of a conductive material having excellent electrical conductivity, preferably, an inexpensive material having low resistivity. For example, the internal electrodes 40 may be formed of at least one of silver (Ag), platinum (Pt), palladium (Pd), gold (Au), copper (Cu), and nickel (Ni), or an alloy thereof, but is not limited thereto.

The internal electrodes 40 may be formed in the body 30 and implement inductance or impedance through an application of electricity. That is, the plurality of internal electrodes 40 may be formed between the magnetic layers, preferably, formed to be close to the non-magnetic layers 50. The plurality of internal electrodes 40 may be sequentially connected to each other by a via electrode (not shown) formed in respective magnetic layers to form the structure of a coil overall, thereby implementing desired characteristics, such as inductance, impedance, and the like.

In addition, output terminals formed at distal ends of the internal electrodes 40 may be exposed to the outside and electrically connected to the respective first and second external electrodes 20.

In the laminated inductor 1, electricity is applied to the coil to form a magnetic field in the coil, and magnetic flux formed by the magnetic field passes through the body 30.

In this case, since the non-magnetic layers 50 are formed of a non-magnetic material, the magnetic flux induced by the coil may not passed through the body 30. Therefore, the magnetic flux may be interrupted to thereby prevent a region around the coil from being magnetized.

Direct current (DC) bias characteristics of the inductor may be advantageous as an inductance change rate according to a current application is small. That is, as inductance is small, a ripple of an output voltage may be great and efficiency may be deteriorated. In addition, as the inductance change rate according to the current application at each temperature is small, the efficiency of the inductor is improved.

In a winding type inductor, since magnetic flux is limited by air, the inductance change rate may be reduced by an open magnetic path effect to thereby improve the DC bias characteristics.

On the other hand, in the case of the laminated inductor, when the current application is undertaken while DC bias increases, the inductance change rate is great, to thereby deteriorate efficiency of the inductance.

However, in the case of the laminated inductor according to the embodiment of the present invention, even though DC bias is increased, magnetic flux is limited by the non-magnetic layers 50, such that the inductance change rate is reduced by an open magnetic path effect to thereby improve DC bias characteristics.

In the related art, copper (Cu)-substituted zinc (Zn)-ferrite is mainly used as a material for the non-magnetic layers. However, in the case of sintering thereof, a nickel (Ni) component of the body is diffused, and a portion in which Ni is diffused has a magnetic property, such that a zinc (Zn) component of the non-magnetic layers is diffused within the body, whereby a thickness of the non-magnetic layers is entirely reduced.

The reduced thickness of the non-magnetic layer causes portions thereof in which curing temperatures respectively are different, and the thickness of the non-magnetic layer is different in the portions thereof according to the temperatures. That is, DC bias characteristics are deteriorated by a mutual diffusion between the body formed of a magnetic material and the non-magnetic layers formed of a non-magnetic material, thereby deteriorating efficiency of the inductor.

In the laminated inductor 1 according to the embodiment of the present invention, the non-magnetic layer 50 includes a $Al_2O_3$ dielectric material as a main component and a K—B—Si-based glass to improve sintering properties and adhesive properties with the body 30 including the magnetic layers and prevent a reduction in the thickness thereof (that is, the thickness of the non-magnetic layers 50) due to the diffusion of Ni and Zn of the inductor according to the related art.

In this case, the $Al_2O_3$ dielectric material having a particle diameter of 500 nm or less may be used, and the content thereof may be 40 to 60 wt % based on 100 wt % of the overall composition. Through the above description, strength of the non-magnetic layers 50 may be improved.

The K—B—Si-based glass may be glass in which 10 to 15% of $K_2O$—$B_2O_3$ is substituted. The K—B—Si-based glass serves to densify a structure of the non-magnetic layers 50 after a firing process, thereby providing adhesive properties with the body 30 formed of the magnetic layers.

Meanwhile, a non-magnetic layer including Zn—Cu ferrite according to the related art may allow a predetermined level of magnetic flux to be interrupted; however, a delamination may be generated due to a difference in a contraction rate between the non-magnetic layer formed of Zn—Cu ferrite and the body formed of a ferrite basic material during a sintering process, and stress is also generated in the inductor.

However, the non-magnetic layers 50 of the laminated inductor 1 of the embodiment of the present invention include an $Al_2O_3$ dielectric material as a main component, and a K—B—Si-based glass, whereby such a defect may be solved.

The non-magnetic layers 50 according to the embodiment of the present invention may be formed as sheets. However, the present invention is not limited thereto. In addition, reference numeral 10, not previously explained, indicates a cover layer 10 covering two surfaces of the body 30.

Figure 3:
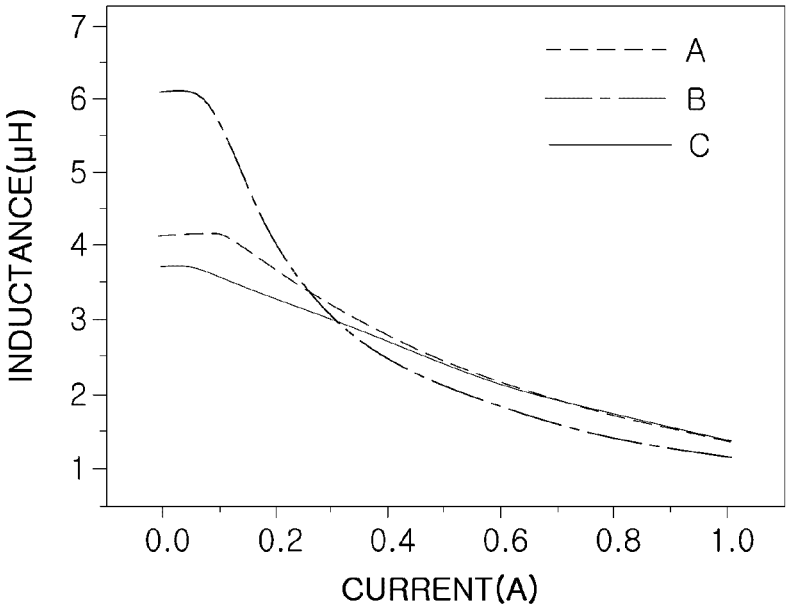
PRIOR ART FIG. 3
FIG. 3 is graph showing bias-temperature coefficient of inductance (TCL) characteristics of a laminated inductor according to the related art.
Figure 4:
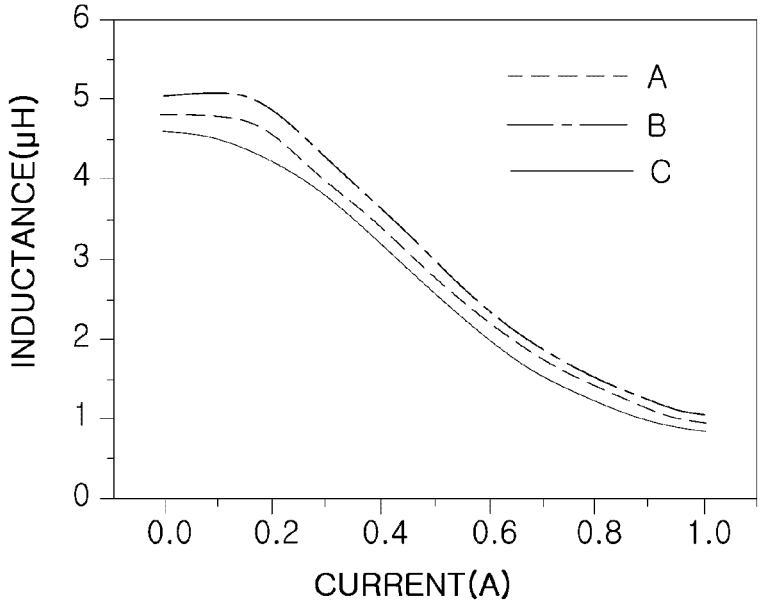
FIG. 4 is a graph showing bias-TCL characteristics of the laminated inductor according to the embodiment of the present invention.
Figure 5:
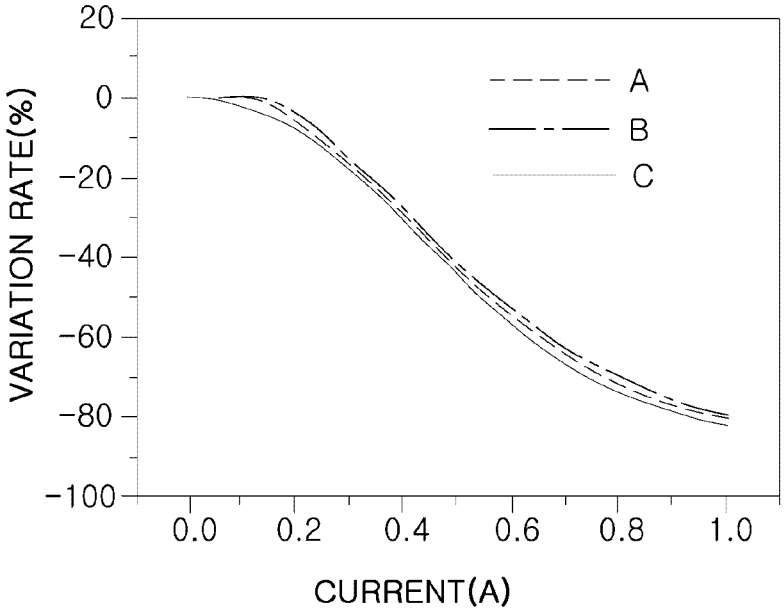
FIG. 5 is a graph showing a change rate of the laminated inductor according to the embodiment of the present invention.

FIG. 3 is a graph showing bias-temperature coefficient of inductance (TCL) characteristics of a laminated inductor according to the related art (hereinafter, referred to as a "comparative example"), and FIGS. 4 and 5 are graphs showing bias-TCL characteristics and a change rate of the laminated inductor according to the embodiment of the present invention (hereinafter, referred to as an 'inventive example').

In both of the comparative example and the inventive example, the number of stacked layers is identical. For non-magnetic layers, three sheets of Zn—Cu ferrite having a thickness of 20 μm were used in the comparative example, and three sheets having a thickness of 8 μm, in which a ratio of $Al_2O_3$ to K—B—Si-based glass is 55:45 were used in the inventive example.

The bias-TCL characteristics may be determined by measuring inductance values after current applications at various temperatures. In general, the measurement may be undertaken in an order of +25° C., −30° C., and +85° C. In FIGS. 3 through 5, A indicates an inductance at 25° C., B indicates an inductance at −30° C., and C indicates an inductance at 85° C., respectively.

It may be appreciated from FIG. 3 that in the comparative example, a difference in an inductance value is large in an initial current, and an inductance change rate is significantly large according to temperature. On the other hand, it may be appreciated from FIGS. 4 and 5 that in the inventive example, unlike the comparative example, there is little difference in an inductance value in an initial current and the overall current, and the inductance change rate is also low.

In particular, comparing FIGS. 3 and 4 with each other, it may be appreciated that in the inventive example, the bias-TCL characteristics are significantly excellent than that of the comparative example, even though the non-magnetic layer is relatively thin, being 8 μm. Therefore, according to the embodiment of the present invention, it may be appreciated that the bias-TCL characteristics of the laminated inductor may be improved, and at the same time, a chip thickness may be reduced.

Therefore, according to the embodiment of the present invention, a magnetic flux propagation path is dispersed in the coil to suppress magnetization in a high current, thereby improving inductance change rate according to a current application.

In addition, the bias-TCL characteristics may be improved according to temperature. In particular, even though the non-magnetic layer according to the embodiment of the present invention has a thickness reduced approximately by half of the non-magnetic layer formed of Zn—Cu ferrite according to the related art, the non-magnetic layer according to the embodiment of the present invention shows DC bias characteristics having the same level as that of the related art, thereby allowing for a decrease in chip thickness at the time of manufacturing a chip.

In addition, costs required for an $Al_2O_3$ dielectric material and a K—B—Si-based glass are lower as compared to the case of using the non-magnetic layer formed of Zn—Cu ferrite according to the related art, such that production costs may be reduced.

Hereinafter, a method of manufacturing a laminated inductor 1 according to the embodiment of the present invention will be described in detail.

First, a $Al_2O_3$ dielectric material and a K—B—Si-based glass are prepared. In this case, the $Al_2O_3$ dielectric material having a particle diameter of 500 nm or less may be used, and the content thereof may be 40 to 60 wt % based on 100 wt % of the overall composition. By doing so, the non-magnetic layers 50 may have strength.

As K—B—Si-based glass, glass in which 10 to 15% of $K_2O$—$B_2O_3$ is substituted may be used, and a softening point of K—B—Si-based glass is about 800 to 850° C. The K—B—Si-based glass serves to densify a structure of the non-magnetic layer after a firing process, thereby providing adhesive properties with the body 30 having the magnetic layer.

In the case of fabricating a molding sheet, a binder may be added in the amount of 15 to 25% as compared to the K—B—Si-based glass, in consideration of a size of a first particle of the glass. In the case of producing a chip, a sheet having a thin thickness corresponding to one-half of the non-magnetic layer formed of Zn—Cu ferrite according to the related art is used, such that diffusion is not greatly generated, thereby implementing an effect equal or greater than that of the related art even in the case of using the non-magnetic layer having a thin thickness.

Meanwhile, in the case of using Zn—Cu ferrite according to the related art as a non-magnetic layer, it is not easy to differentiate the non-magnetic layer from the magnetic layer of the body. However, in the case of using the non-magnetic layers 50 having the $Al_2O_3$ dielectric material and the K—B—Si-based glass, as in the embodiment of the present invention, the non-magnetic layers 50 may be clearly differentiated from the magnetic layer of the body 30, which means that DC bias characteristics are improved.

As set forth above, according to the embodiment of the present invention, the laminated inductor having improved inductance change characteristics according to a current application while having a reduced size and a high current can be provided.

While the present invention has been shown and described in connection with the embodiments, it will be apparent to those skilled in the art that modifications and variations can be made without departing from the spirit and scope of the invention as defined by the appended claims.

What is claimed is:

1. A laminated inductor, comprising:

a body in which a plurality of magnetic layers are stacked;

at least one non-magnetic layer interposed between the magnetic layers and including an $Al_2O_3$ dielectric material as a main component, and a K—B—Si-based glass such that a content of the $Al_2O_3$ dielectric material is greater than a content of the K—B—Si-based glass; and a plurality of internal electrodes formed on the magnetic layers, wherein the $Al_2O_3$ dielectric material has a content of 40 wt % to 60 wt % based on 100 wt % of an overall composition, and wherein the K—B—Si-based glass is glass in which 10 to 15% of $K_2O$—$B_2O_3$ is substituted.

2. The laminated inductor of claim 1, wherein the $Al_2O_3$ dielectric material has a particle diameter of 500 nm or less.

3. The laminated inductor of claim 1, wherein the internal electrodes are formed of at least one of silver (Ag), platinum (Pt), palladium (Pd), gold (Au), copper (Cu), and nickel (Ni), or an alloy thereof.

4. The laminated inductor of claim 1, further comprising first and second external electrodes formed on outer surfaces of the body and respectively connected to both ends of the internal electrodes.

* * * * *